United States Patent [19]

Fischer

[11] 4,176,505

[45] Dec. 4, 1979

[54] CONNECTING ELEMENT

[76] Inventor: Artur Fischer, Weinhalde 34, D-7244 Waldachtal 3 (Tumlingen), Fed. Rep. of Germany

[21] Appl. No.: 898,135

[22] Filed: Apr. 20, 1978

[30] Foreign Application Priority Data

Jun. 18, 1977 [DE] Fed. Rep. of Germany ... 7719132[U]

[51] Int. Cl.[2] ..... E04C 1/10

[52] U.S. Cl. ..... 52/582; 52/391; 52/509

[58] Field of Search ..... 52/578, 582, 583, 585, 52/586, 587, 591, 509, 506, 391, 387, 271; 46/25, 31

[56] References Cited

U.S. PATENT DOCUMENTS

| | | | |
|---|---|---|---|
| 3,614,915 | 10/1971 | Perry | 52/586 |
| 3,874,133 | 4/1975 | Silvius | 52/582 |
| 3,902,291 | 9/1975 | Zucht | 52/586 X |
| 3,905,169 | 9/1975 | Gallo | 52/509 X |
| 4,074,496 | 2/1978 | Fischer | 52/391 X |

FOREIGN PATENT DOCUMENTS

| | | | |
|---|---|---|---|
| 605835 | 7/1948 | United Kingdom | 52/582 |

*Primary Examiner*—J. Karl Bell

*Attorney, Agent, or Firm*—Michael J. Striker

[57] ABSTRACT

A connecting element for cruciformly connecting quadrangular structural elements each having a connecting surface, has a plate-like member including a central portion having lateral sides, and side portions each located at one of said lateral sides of the central portion. The central portion and the side portions have supporting surfaces arranged to support the connecting surfaces of the structural element and provided with means for connecting the latter to the plate-like member. The supporting surface of the central portion has dimensions which are at least equal to the dimensions of the connecting surface of the structural element, whereas the supporting surface of each of the side portions has at least one dimension which is smaller than a corresponding dimension of the structural element. In such a construction when one of the structural elements is connected to the central portion and other structural elements are connected to the side portions of the plate-like member, the structural elements are cruciformly arranged relative to one another and a section of the connecting surface of each of the other structural elements projects beyond the respective side portion and thus remains free for connecting with a further structural element.

8 Claims, 1 Drawing Figure

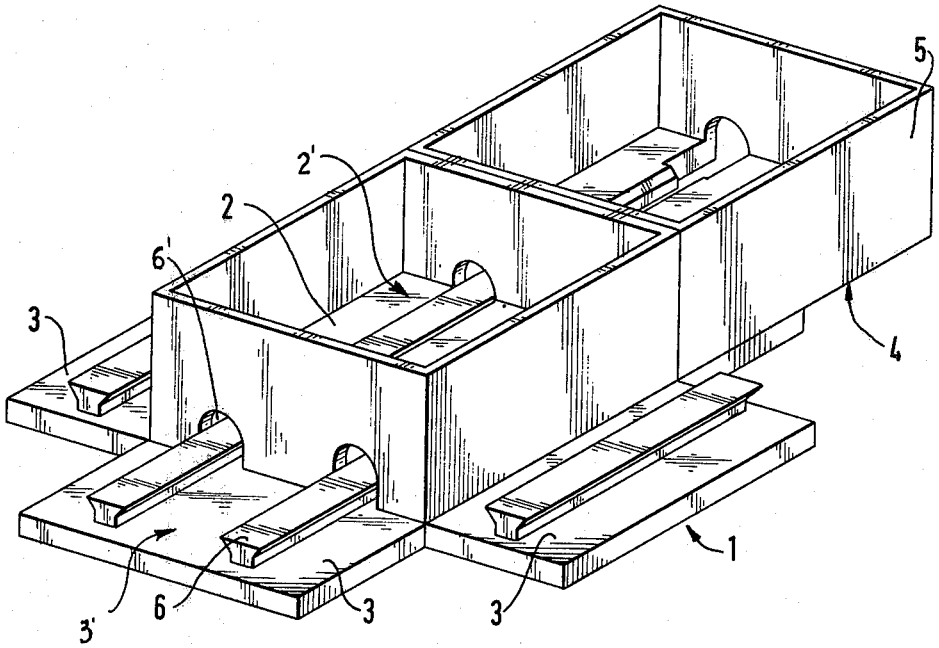
5
2'
2
6'
3
4
1
3'
6
3
3

CONNECTING ELEMENT

BACKGROUND OF THE INVENTION

The present invention relates to a connecting element for cruciformly connecting structural elements. More particularly it relates to a connecting element for cruciformly connecting structural elements which have square or rectangular connecting surfaces.

Connecting elements of this known type has been used as structural elements of construction assembly kits. Generally, the known connecting elements serve for cruciformly connecting bar-shaped members, for example for manufacturing skeletal structures. The bar-shaped members are provided with reinforcements which serve only for lengthening of the connecting parts of the connecting plate. The known connecting plates are not suitable, however, for cruciformly connecting quadrangular structural elements with one another.

SUMMARY OF THE INVENTION

Accordingly, it is an object of the present invention to provide a connecting element which avoids the disadvantages of the prior art.

More particularly, it is an object of the present invention to provide a connecting element for cruciformly connecting quadrangular structural elements with one another.

In keeping with these objects, and with others which will become apparent hereinafter, one feature of the present invention resides in a connecting element which includes a cruciform plate-like member having a central portion, side portions and connecting means wherein dimensions of a supporting surface of the central portion are at least equal to the dimensions of a connecting surface of the structural element to be connected to the plate-like member, whereas, at least one dimension of a supporting surface of each of the side portions is smaller than a corresponding dimension of the structural element.

In such a construction one of the structural elements can be connected to the central portion of the plate-like member, whereas other structural elements are connected to the side portions of the plate-like member, whereby the structural elements are cruciformly arranged relative to one another.

Inasmuch as at least one of the dimensions of the supporting surface of each of the side portions is smaller than the corresponding dimension of the structural element, a section of the connecting surface of each of the structural elements mounted on the side portions of the plate-like member projects beyond the respective side portion and thus remains free for connection with a further structural element.

In accordance with another feature of the present invention, the dimensions of the supporting surface of the central portion are equal to the dimensions of the structural element, at least one of the dimensions of each of the side portions is equal to half of the corresponding dimension of the structural element, and connecting means for connecting the structural elements to the plate-like member are so arranged that lateral walls of the structural element connected to the central portion abut against a corresponding lateral wall of the structural element connected to a respective one of the side portions of the plate-like member.

In accordance with still another feature of the present invention the connecting means for connecting the structural elements to the connecting plate extend in one direction and are parallel to one another. Such connecting means may be constituted by undercut projections which engage in undercut grooves of the structural elements. When the above-mentioned connecting means or undercut projections are arranged in the same direction and are parallel to one another, the structural elements are shifted over the connecting means by identically moving the structural elements relative to the latter. This provides for a simplification of assembling of the structural elements with one another so that it can be performed by children of preschool age.

The structural elements may be rectangular, in which case the central portion and the side portions of the plate-like member are also rectangular. On the other hand, the structural elements may be square, in which case the central portion of the plate-like member is square, whereas the side portions of the same are rectangular.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a perspective view showing a connecting element for cruciformly connecting structural elements with one another, as well as the structural elements connected by the same.

DESCRIPTION OF A PREFERRED EMBODIMENT

A connecting element for cruciformly connecting quadrangular structural elements with one another is formed as a plate-like member which is identified in toto by reference numeral 1. The plate-like member 1 is cruciform and includes a central portion 2 and side portions 3. Each of the side portions 3 is located at one of the lateral sides of the central portion 2 of the plate-like member 1. The central portion 2, as well as the side portions 3, have supporting surfaces which are identified by reference numerals 2' and 3' respectively.

Quadrangular structural elements to be cruciformly connected with one another are identified by reference numeral 5. Each of the structural elements 5 has a connecting surface 4 adapted to be positioned on the supporting surface 2' or 3' of the central portion 2 or the side portions 3 of the plate-like member 1. Means for connecting the structural elements 5 to the plate-like member 1 are so arranged on the supporting surfaces 2' and 3' of the central portion 2 and the side portions 3 of the plate-like member 1, respectively. The structural elements 5 shown in the drawing are square, however, it is understood that they also may be rectangular.

The supporting surface 2' of the central portion 2 of the plate-like member 1 has dimensions which are at least equal to the dimensions of the connecting surface 4 of the structural element 5. In such a construction the structural element 5 may be mounted on the central portion 2 of the plate-like member 1 in such a manner that it does not project outwardly beyond the central portion 2. The other structural elements 5 can be arranged in all four directions laterally adjacent to the central structural elements 5 mounted on the central portion 2. These other structural elements are mounted on the side portions 3 of the plate-like member 1. The mounting of the structural elements 5 to the plate-like member 1 is performed by interaction of the connecting means 6 of the plate-like member 1 and connecting means of the structural elements. As shown in the drawing, the connecting means of the plate-like member 1 may be formed as undercut projections, whereas the connecting means of the structural elements 5 may be formed as undercut grooves in which the projections 6 can engage.

One of the dimensions of each of the side portions 3 of the plate-like member 1 is smaller than a corresponding dimension of the structural element 5. As shown in the drawing, the width of the left and right side sections 3 is smaller than the width of the structural element 5, whereas the length of the front and the rear side portions 3 is smaller than the length of the structural element 5. In such a construction a section of the connecting surface 5 of each of the structural elements 5 connected to the side portions 3 of the plate-like member 1 projects beyond the respective side portion 3 and thus remains free for connection with a further structural element.

As shown in the drawing, the connecting means, that is the undercut projections 6 and the undercut grooves 6' extend in the same direction and are parallel to one another. Therefore, the structural elements 5 can be shifted over the undercut projections 6 of the plate-like member 1 by movement in an identical direction. As can be clearly seen from the drawing, when the structural elements 5 are square, the central portion 2 of the plate-like member 1 is preferably also square, whereas the side portions 3 of the same are rectangular. It is to be understood that when the structural elements 5 are rectangular, both the central portion 2 and the side portions 3 of the plate-like member 1 are rectangular.

The central portion 2 and the side portions 3 of the plate-like member 1 may be so dimensioned that the dimensions of the supporting surfaces 2' of the central portion 2 of the plate-like member 1 are equal to the dimensions of the connecting surface 4 of the structural element 5, and one of the dimensions of the supporting surface 3' of each of the side portions 3' is equal to half of the corresponding dimension of the connecting surface 4 of the structural element 5. In such a construction when the structural elements are mounted on the central portion 2 and the side portions 3 of the plate-like member 1 lateral walls of the structural element 5 mounted on the central portion 2 abut against a respective lateral wall of the structural elements 5 mounted on the side portions 3 of the plate-like member 1. In this construction, one half of the connecting surface 4 of each of the structural elements 5 mounted on the side portions 3 is supported on the supporting surface 3' of the corresponding side portion 3, whereas another half of the connecting surface 4 of each of the structural elements 5 mounted on the side portions 3 projects beyond the latter and thus remains free for connection with a further structural element.

It will be understood that each of the elements described above, or two or more together, may also find a useful application in other types of constructions differing from the types described above.

While the invention has been illustrated and described as embodied in a connecting element for cruciformly connecting quadrangular structural elements with one another, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A connecting element for cruciformly connecting quadrangular structural elements each having a connecting surface, comprising a cruciform plate-like member including a central portion having lateral sides, and side portions each located at one of said lateral sides of said central portion, said central portion and said side portions having supporting surfaces arranged to support the connecting surfaces of the structural elements and provided with means for connecting the latter to said plate-like member, the supporting surface of said central portion having dimensions which are at least equal to the dimensions of the connecting surface of the structural element, whereas the supporting surface of each of the side portions has at least one dimension which is smaller than a corresponding dimension of the structural element so that, when one of the structural elements is connected to said central portion and other structural elements are connected to said side portions of said plate-like member, the structural elements are cruciformly arranged relative to one another, and a section of the connecting surface of each of said other structural elements projects beyond the respective side portion and thus remains free for connection with a further structural element.

2. The connecting element as defined in claim 1, wherein the structural elements are rectangular, said central portion and said side portions of said plate-like member being rectangular.

3. The connecting element as defined in claim 1, wherein the structural elements are square, said central portion of said plate-like member being square, whereas each of said side portions of said plate-like element is rectangular.

4. The connecting element as defined in claim 1, wherein said dimensions of said supporting surface of said central portion are equal to the dimensions of the connecting surface of the structural element.

5. The connecting element as defined in claim 1, wherein said one dimension of said supporting surface of each of said side portions is equal to half of the corresponding dimension of the structural element.

6. The connecting element as defined in claim 1, wherein said connecting means includes elongated formations extending in one direction and parallel to one another.

7. The connecting element as defined in claim 6, wherein said formations are undercut projections.

8. The connecting element as defined in claim 1, wherein the structural elements have lateral walls, said dimensions of said central portion of said plate-like member being equal to the dimensions of the structural element, whereas said one dimension of each of said side portions of said plate-like member is equal to half of the corresponding dimension of the structural element, said connecting means being so arranged that when one of the structural elements is connected to said central portion and the other structural elements are connected to said side portions of said plate-like member, one of the lateral walls of each of the other structural elements abuts against a corresponding wall of the one structural element.

* * * * *